US007918114B2

(12) United States Patent
Walsh, III

(10) Patent No.: US 7,918,114 B2
(45) Date of Patent: Apr. 5, 2011

(54) ELECTRONIC LOCK ACTUATOR WITH HELICAL DRIVE MEMBER

(75) Inventor: John E. Walsh, III, Wallingford, CT (US)

(73) Assignee: Harrow Products LLC, Montvale, NJ (US)

( * ) Notice: Subject to any disclaimer, the term of this patent is extended or adjusted under 35 U.S.C. 154(b) by 657 days.

(21) Appl. No.: 11/988,397

(22) PCT Filed: Jul. 7, 2006

(86) PCT No.: PCT/US2006/026572

§ 371 (c)(1),
(2), (4) Date: Jan. 7, 2008

(87) PCT Pub. No.: WO2007/008694

PCT Pub. Date: Jan. 18, 2007

(65) Prior Publication Data

US 2009/0277232 A1 Nov. 12, 2009

Related U.S. Application Data

(60) Provisional application No. 60/697,347, filed on Jul. 7, 2005.

(51) Int. Cl.
*E05B 47/06* (2006.01)

(52) U.S. Cl. ..... 70/283; 70/277; 70/278.1; 70/472; 70/223

(58) Field of Classification Search ..... 70/277, 70/278.1, 278.3, 279.1–283, 472, 221–223
See application file for complete search history.

(56) References Cited

U.S. PATENT DOCUMENTS

| | | | | |
|---|---|---|---|---|
| 5,018,375 | A | 5/1991 | Tully | |
| 5,083,122 | A | 1/1992 | Clark | |
| 5,421,178 | A | 6/1995 | Hamel et al. | |
| 5,628,216 | A | 5/1997 | Qureshi et al. | |
| 5,694,798 | A | 12/1997 | Nunez et al. | |
| 7,003,993 | B1 | 2/2006 | Zehrung | |
| 2006/0042337 | A1 * | 3/2006 | Su | 70/472 |

OTHER PUBLICATIONS

Office Action from United Kingdom Patent Office for Application GB0800156.2 dated Sep. 30, 2009 (3 pages).
Office Action from New Zealand Patent Office for Application 564924 dated Sep. 11, 2009 (2 pages).

* cited by examiner

*Primary Examiner* — Suzanne D Barrett
(74) *Attorney, Agent, or Firm* — Michael Best & Friedrich LLP

(57) ABSTRACT

An actuator assembly is for a lock including a handle, a latch, a retractor for retracting the latch when the handle rotates, and a lock member displaceable between locked and unlocked positions, which either releasably couples the handle with the retractor or releasably prevents handle rotation. The actuator includes a motor having a shaft rotatable about an axis and a coupler spring disposed about the axis and having a first end coupled with the lock member and a second end. A drive member is coupled or integrally formed with the motor shaft and has a helical drive surface threadably engaged with the coupler spring second end, such that rotation of the shaft displaces the coupler spring along the axis to move the lock member between the locked and unlocked positions. Preferably, the drive member includes a spring coupled with the motor shaft and threadably engaged with the coupler spring.

22 Claims, 9 Drawing Sheets

ELECTRONIC LOCK ACTUATOR WITH HELICAL DRIVE MEMBER

RELATED APPLICATIONS

This application is a 371 of PCT/US2006/026572, filed on Jul. 7, 2006, which claims the benefit of U.S. Provisional Patent Application No. 60/697,347, filed on Jul. 7, 2005.

BACKGROUND OF THE INVENTION

The present invention relates to electronic locks, and more particularly to actuator devices for such electronic locks.

Electronic locks typically include an actuator assembly for displacing a lock member to alternatively lock and unlock a door, cabinet, or other barrier secured by the lock. Often, such lock members include a plunger, a cam or similar coupler that is operably connected to a motor, solenoid, etc. that displaces the lock member in alternative directions. The lock member may be connected with the motor through a variety of means, such as a gear train, a bar mechanism, or other linkage.

SUMMARY OF THE INVENTION

In one aspect, the present invention is an actuator assembly for an electronic lock, the lock including a lock member linearly displaceable between a locked position and an unlocked position. The actuator comprises a motor having a shaft rotatable about a central axis and a coupler spring disposed about the axis and having a first end coupled with the lock member and a second, opposing end. A drive member is either coupled with, or integrally formed with, the motor shaft and has a helical drive surface threadably engaged with the coupler spring second end. As such, rotation of the motor shaft displaces the coupler spring generally linearly along the axis to move the lock member between the locked and unlocked positions.

In another aspect, the present invention is again an actuator assembly for an electronic lock, the lock including a lock member linearly displaceable between a locked position and an unlocked position. The actuator comprises a motor having a shaft rotatable about a central axis and a coupler spring having a first end coupled with the lock member and a second, opposing end. A drive spring is coupled with the motor shaft and is threadably engaged with the coupler spring second end. As such, rotation of the motor shaft displaces the coupler spring generally linearly along the axis to move the lock member between the locked and unlocked positions.

In a further aspect, the present invention is an electronic lock comprising a linearly displaceable latch and a rotatable handle operatively coupleable with the latch. A lock member is linearly displaceable between a locked position, at which the handle is noncoupled with latch, and an unlocked position at which the lock member operatively couples the handle with the latch. A motor has a shaft rotatable about a central axis and a coupler spring has a first end coupled with the locking member and a second, opposing end. Further, a drive spring is coupled with the motor shaft and threadably engaged with the coupler spring second end. As such, rotation of the motor shaft displaces the coupler spring generally linearly along the axis to move the lock member between the locked and unlocked positions.

In yet another aspect, the present invention is again an actuator assembly for an electronic lock, the lock including a locking member linearly displaceable between locked and unlocked positions. The actuator comprises a motor having a shaft rotatable about a central axis and a coupler spring having a first end coupled with the locking member and a second, opposing end. A drive member is either coupled with, or integrally formed with, the motor shaft and is engaged with the coupler spring second end. The drive member has at least one helical drive surface contactable with at least one coil of the coupler spring such that rotation of the motor shaft displaces coupler spring generally linearly along the axis to move the locking member between the locked and unlocked positions.

In an even further aspect, the present invention is an electronic lock comprising a fixed base member, a latch linearly displaceable between an extended position and a retracted position, and a retractor spindle configured to displace the latch toward the retracted position. A handle is rotatable about an axis, operatively coupled with the latch and configured to displace the latch toward the retracted position when the handle rotatably displaces about the axis. A lock member is coupled with the retractor spindle and is linearly displaceable between a locked position, at which the lock member is engaged with the base member so as to substantially prevent rotation of the handle about the handle axis, and an unlocked position at which the locking member is noncoupled with the base member such that the handle is rotatable about the handle axis. A motor has a shaft rotatable about a central axis and a coupler spring has a first end coupled with the locking member and a second, opposing end. Further, a drive spring is coupled with the motor shaft and is threadably engaged with the coupler spring second end, such that rotation of the motor shaft displaces the coupler spring generally linearly along the axis to move the lock member between the locked and unlocked positions.

BRIEF DESCRIPTION OF THE SEVERAL VIEWS OF THE DRAWINGS

The foregoing summary, as well as the detailed description of the preferred embodiments of the present invention, will be better understood when read in conjunction with the appended drawings. For the purpose of illustrating the invention, there is shown in the drawings, which are diagrammatic, embodiments that are presently preferred. It should be understood, however, that the present invention is not limited to the precise arrangements and instrumentalities shown. In the drawings.

DETAILED DESCRIPTION OF THE INVENTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings and are thus intended to include direct connections between two members without any other members interposed therebetween and indirect connections between members in which one or more other members are interposed therebetween. Further, "connected" and "coupled" are not restricted to physical or mechanical connections or couplings.

Figure 6:
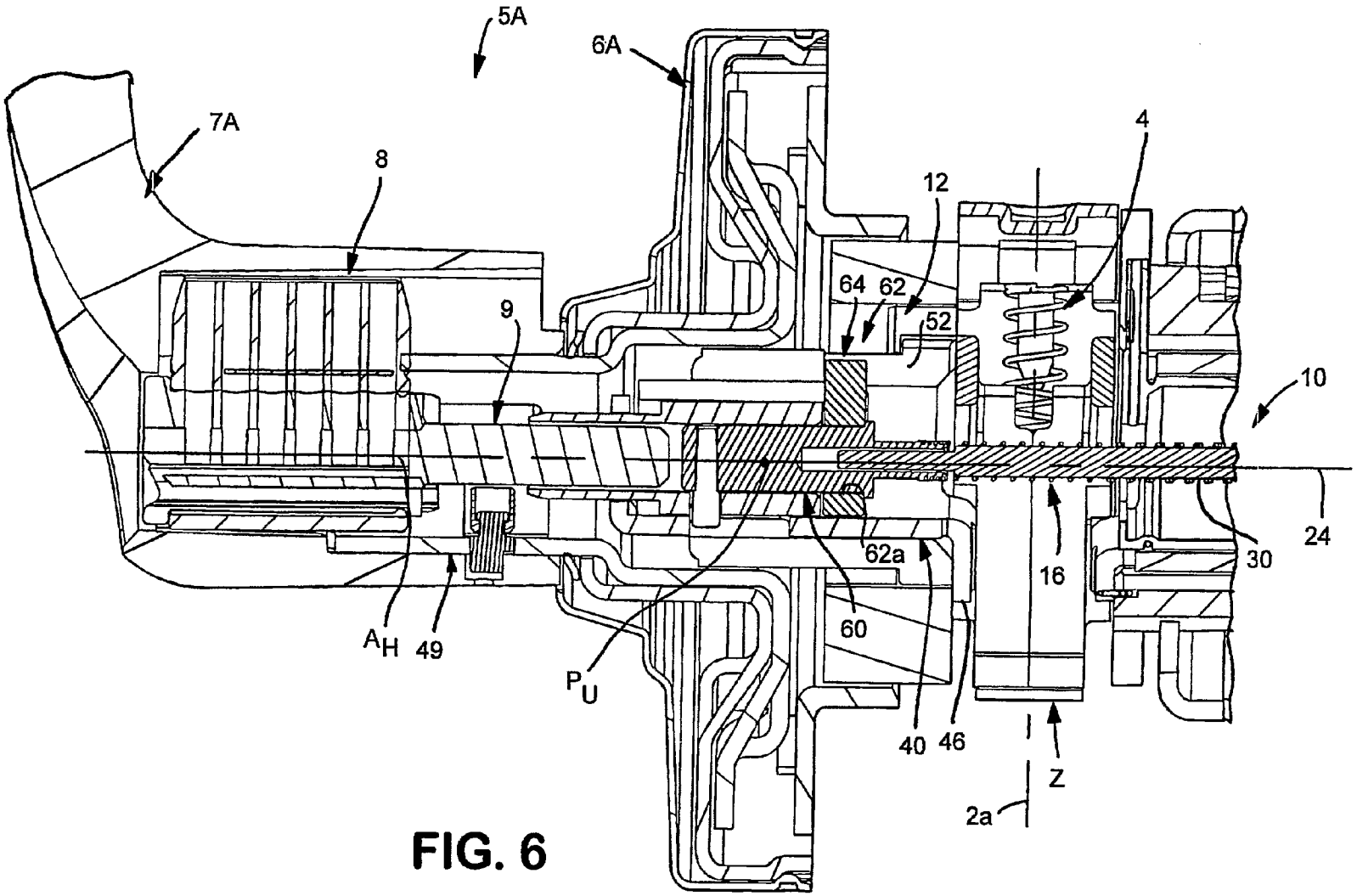
FIG. 6 is another view of the lock assembly of FIG. 5, showing the lock member in an unlocked position.
Figure 7:
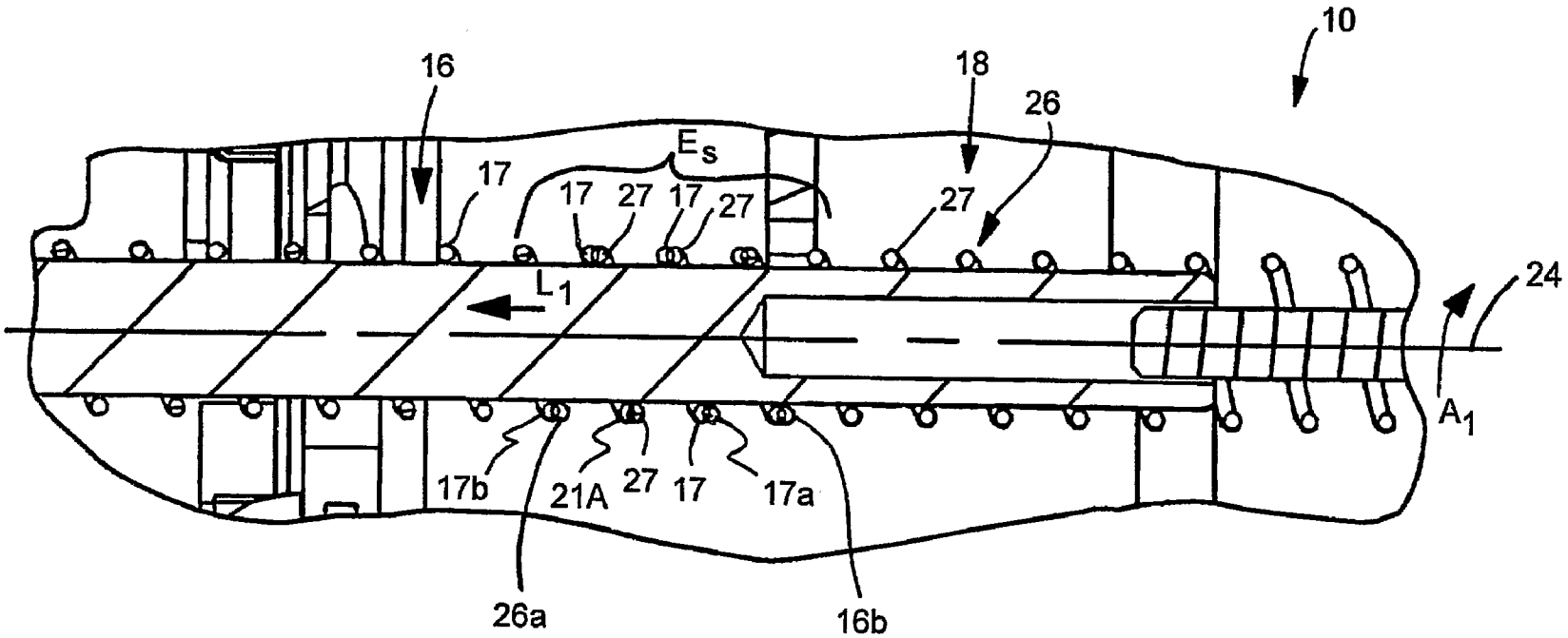
FIG. 7 is a greatly enlarged, axial cross-sectional view of an actuator engagement portion.
Figure 8:
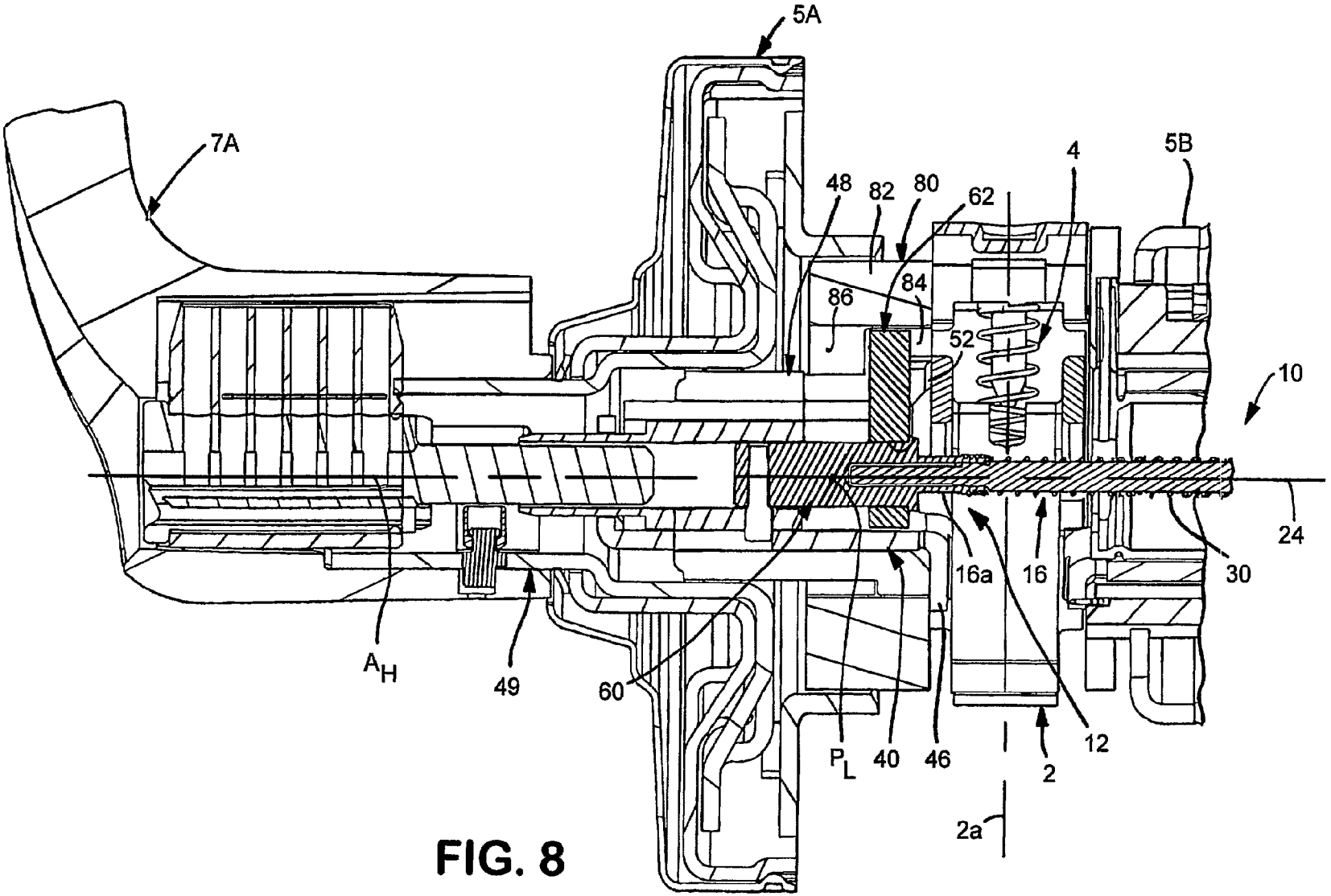
FIG. 8 is a greatly enlarged, broken-away axial cross-section of an alternative construction of the lock assembly, showing a lock member in a locked position.
Figure 9:
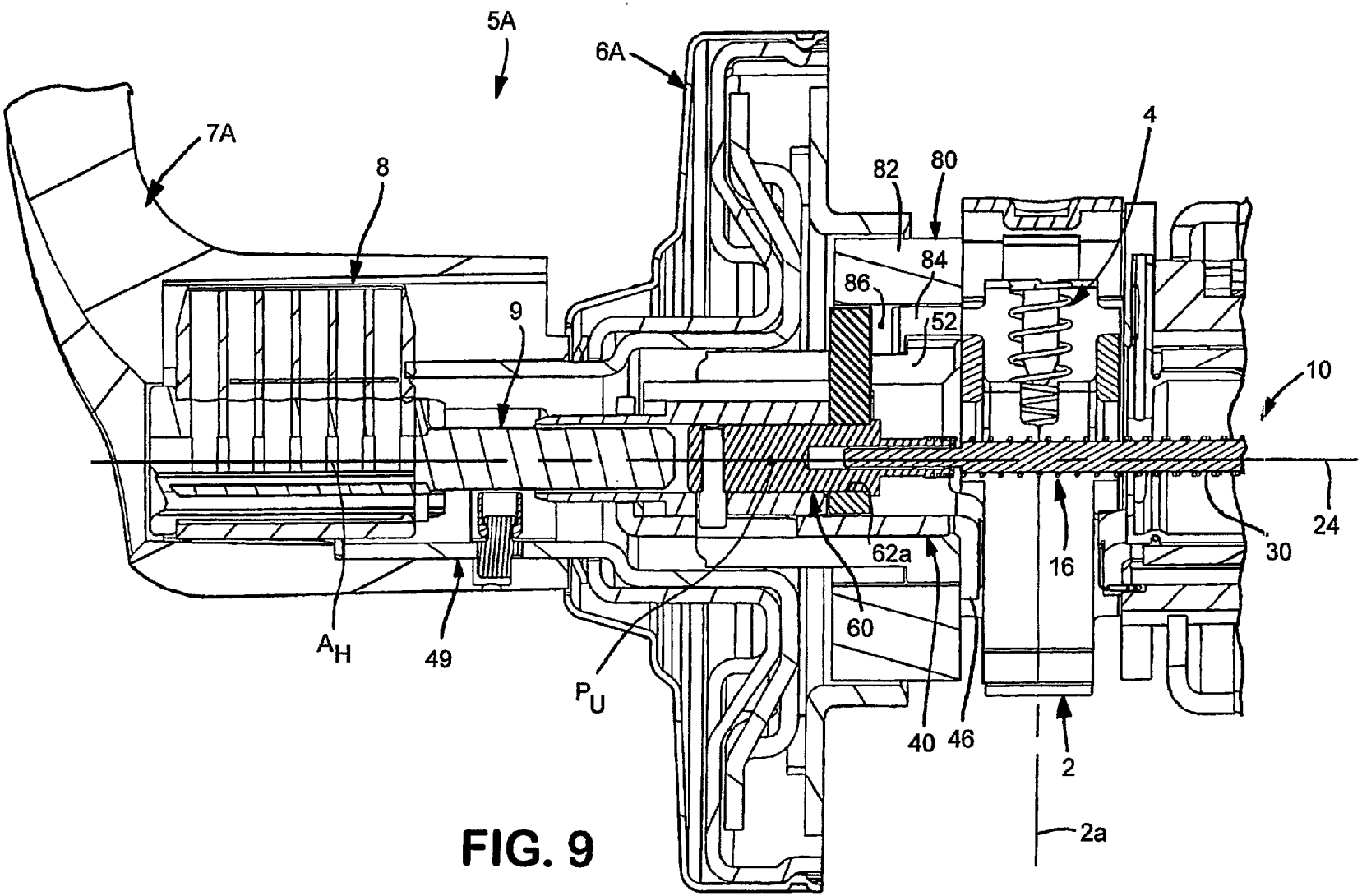
FIG. 9 is another view of the lock assembly of FIG. 8, showing the lock member in an unlocked position.

Referring now to the drawings in detail, wherein like numbers are used to indicate like elements throughout, there is shown in FIGS. 1-9 a presently preferred embodiment of an actuator assembly 10 for an electronic lock 1. The lock 1 includes a linearly displaceable latch 2, at least one handle 3 operatively coupleable or coupled with the latch 2, and a lock member 12 linearly displaceable between a locked position $P_L$ (FIGS. 5 and 8) and an unlocked position $P_U$ (FIGS. 6 and 9). The actuator assembly 10 basically comprises a motor 14, a coupler spring 16 connected with the lock member 12, and a drive member 18 operatively connecting the motor 14 with the coupler spring 16. The motor 14 has a shaft 22 rotatable about a central actuator axis 24, and preferably alternatively rotatable in opposing angular directions $A_1$, $A_2$ (see FIG. 4) The coupler spring 16 is disposed about the axis 24 and has a first end 16*a* coupled with the lock member 12 and a second, opposing end 16*b*. Further, the drive member 18 is preferably coupled with, but may alternatively be integrally formed with, the motor shaft 22 and has at least one helical drive surface 20 threadably engaged with the coupler spring second end 16*b*, the drive surface 20 extending circumferentially about and linearly along the axis 24. As such, rotation of the motor shaft 22 displaces the coupler spring 16 generally linearly along the axis 24 to move the lock member 12 between the locked and unlocked positions $P_L$, $P_U$.

Figure 4:
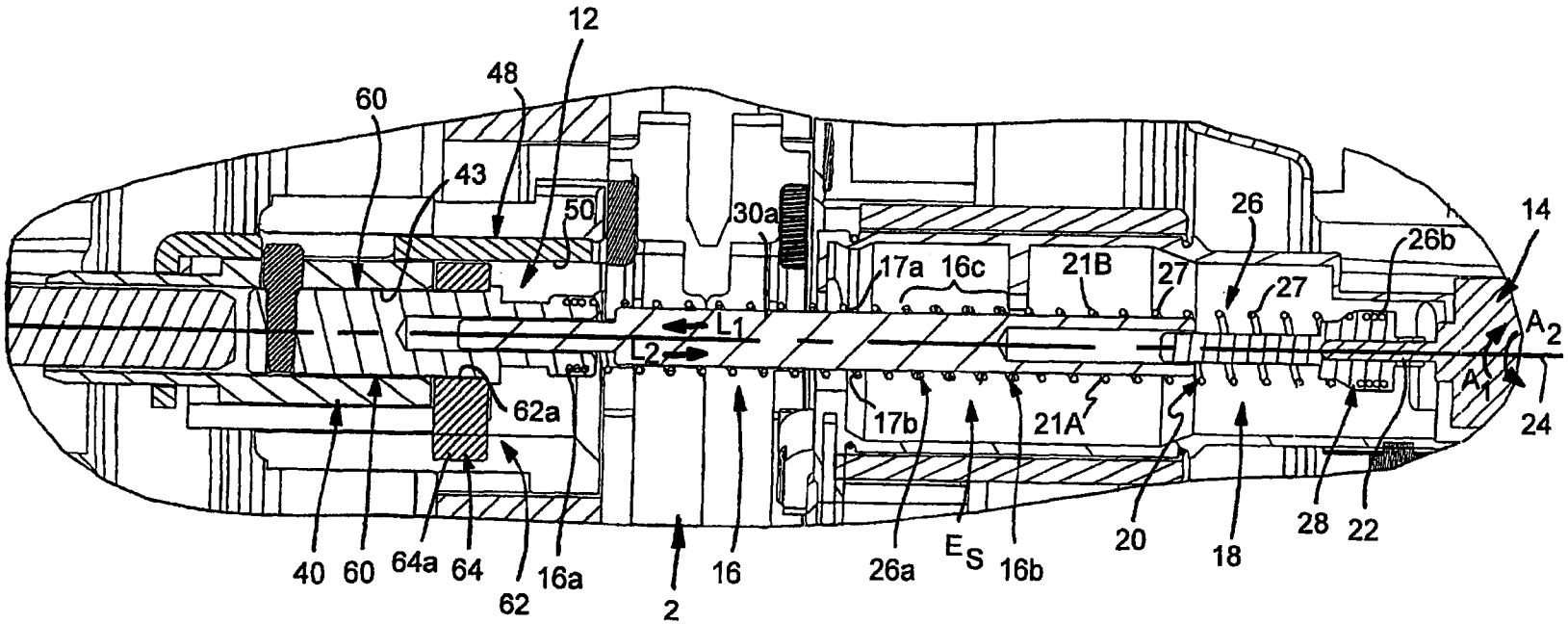
FIG. 4 is another axial cross-sectional view of the lock assembly, showing different constructions of certain portions of the actuator assembly.
Figure 5:
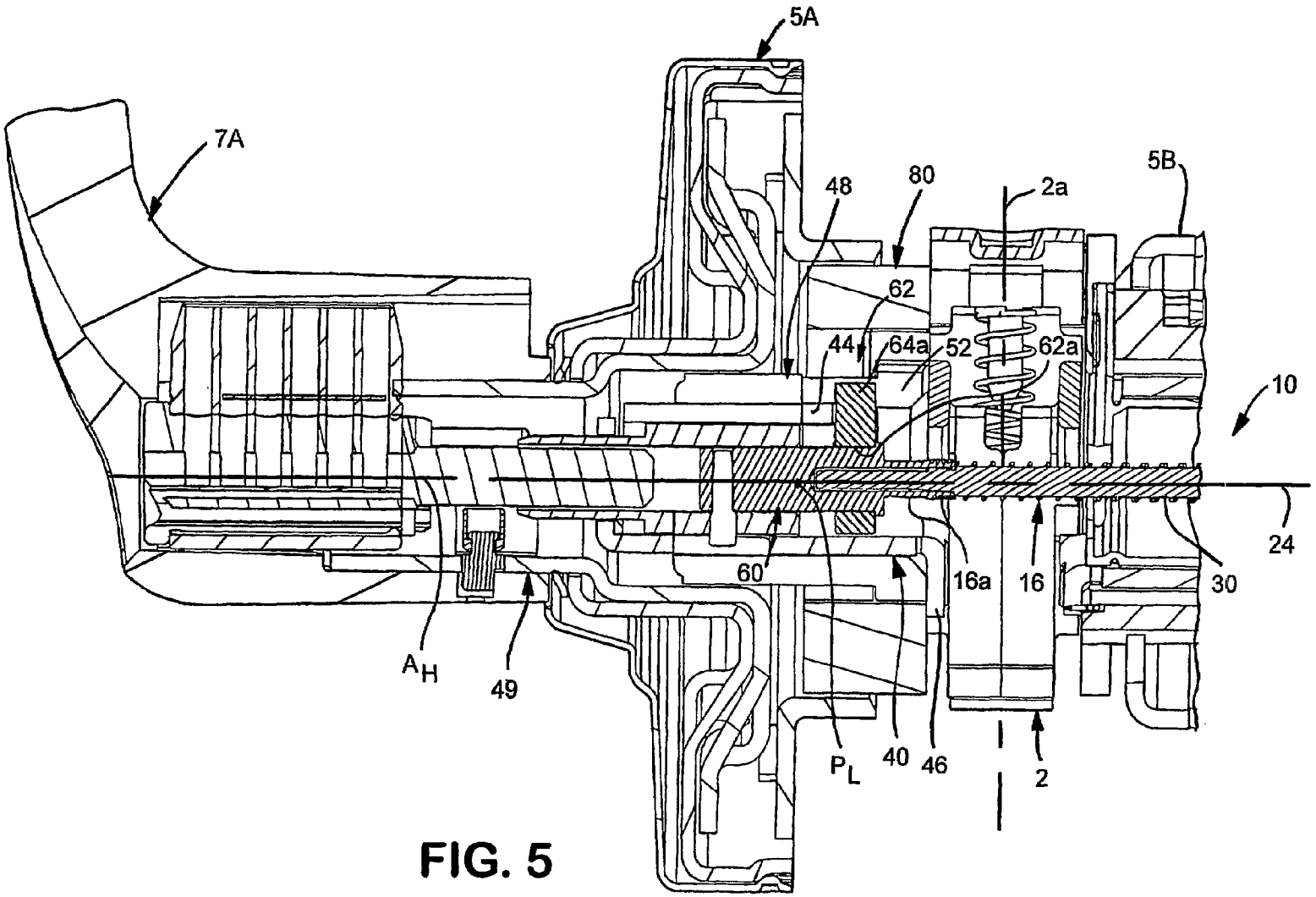
FIG. 5 is a greatly enlarged, broken-away axial cross-section of the lock assembly, showing a lock member in a locked position.

Preferably, the coupler spring 16 is a helical spring having at least a plurality of coils 17 (e.g., fourteen coils), each coil 17 having opposing, first and second axially-facing surfaces 17*a*, 17*b*. The helical drive surface 20 engages a portion 16*c* (see FIG. 4) of the spring 16 that includes a lesser plurality of the total number of coils 17 (e.g., four coils). Further, the drive member 18 preferably has opposing, first and second helical drive surfaces 21A, 21B, each drive surface 21A, 21B being contactable with a separate group of the coil axially-facing surfaces 17*a*, 17*b*, respectively. With this structure, the first helical drive surface 21A is contactable with the coil first surfaces 17*a* when the motor shaft 22 rotates in a first angular direction $A_1$ about the central axis 24, so as to displace or "push" the coupler spring 16 in a first linear direction $L_1$ along the axis 24, as indicated in FIGS. 4 and 7. Alternatively, the second helical drive surface 21A is contactable with the coil second surfaces 17*b* when the motor 14 rotates in a second angular direction $A_2$, to thereby displace or "pull" the coupler spring 16 in a second linear direction $L_2$ along the axis 24 (see FIG. 4).

Figure 2:
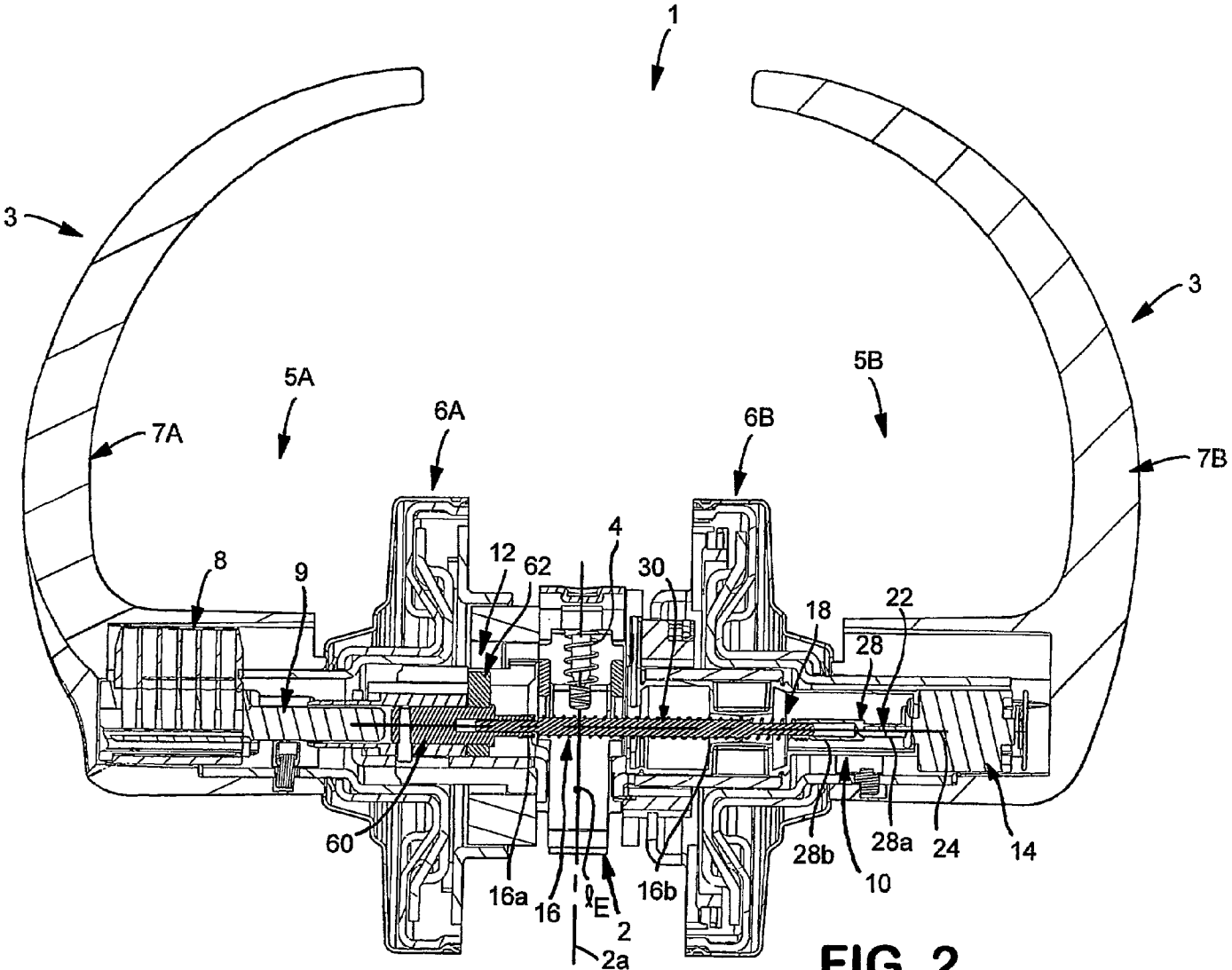
FIG. 2 is an axial cross-sectional view of the lock assembly of FIG. 1.
Figure 3:
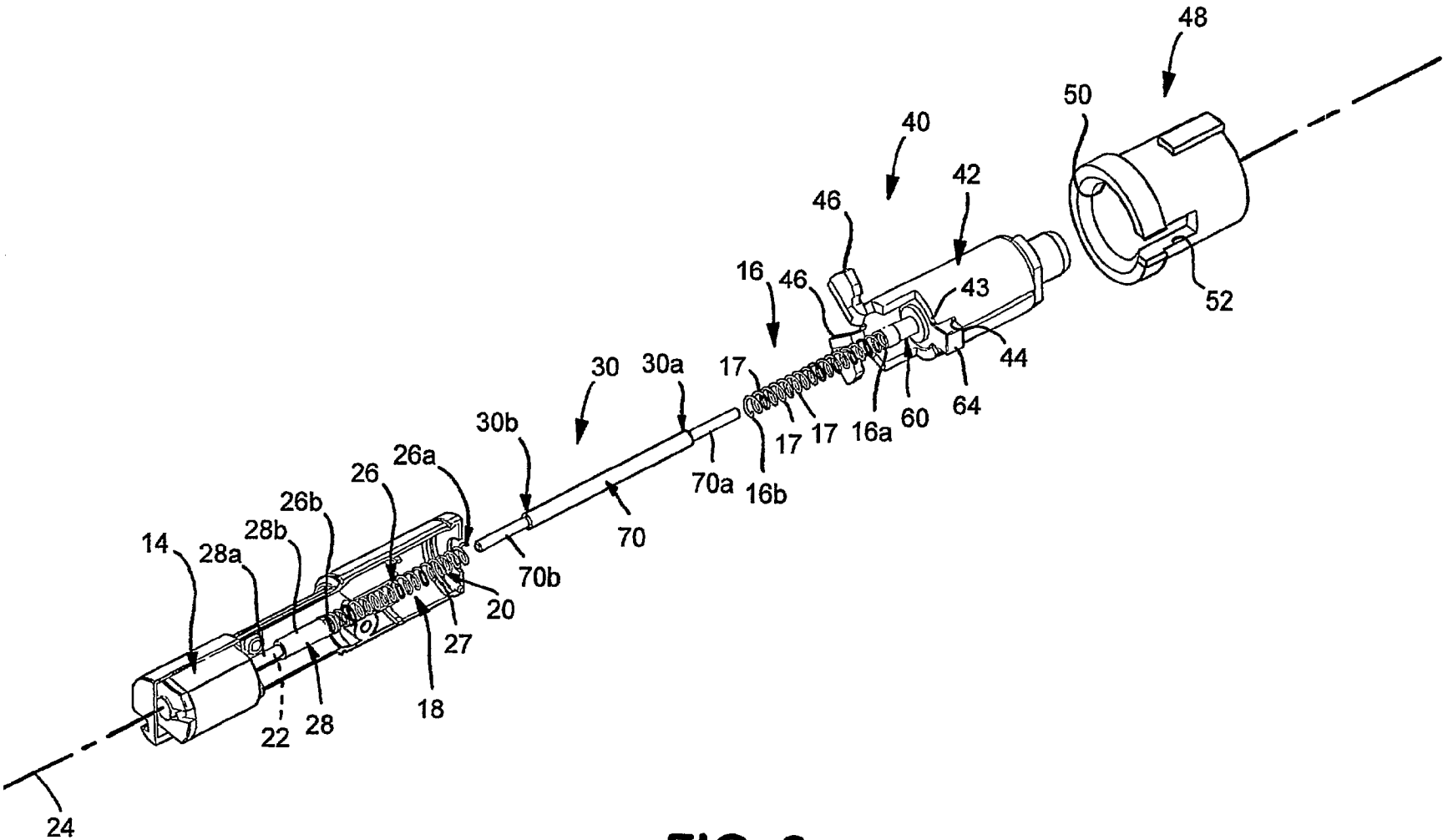
FIG. 3 is an exploded view of certain primary components of the lock actuator of the present invention.

Most preferably, the drive member 18 includes or is substantially formed as a helical spring 26 having a first end 26*a* threadably engaged with the coupler spring 16 and a second end 26*b* connected with the motor shaft 22. Preferably, the actuator 10 further includes an attachment member 28 having a first portion 28*a* attached to the motor shaft 22 and an opposing, second portion 28*b* to which the drive spring second end 26*b* is attached, thus coupling the spring 26 to the motor shaft 22, as best shown in FIG. 2. When the actuator 10 is assembled as discussed below, the drive spring first end 26*a* preferably has a plurality of coils 27 threadably engaged with, or "interwound" with, a plurality of coils 17 of the coupler spring portion 16*c*, so as to form an actuator engagement section $E_S$ (see FIG. 4). Further, the actuator assembly 10 preferably further comprises an elongated support member 30 having a first portion 30*a* disposed within the coupler spring 16 and a second portion 30*b* disposed within the drive member spring 26. As such, the support member 30 retains each of the coupler spring 16 and the coil spring 26 generally centered about the axis 24. In other words, the support member 30 retains the coupler spring 16 displacing along the central axis 24, and the drive spring 26 rotating about the axis 24, without any lateral or sideways deflection or displacement of either component 16, 24 in directions generally perpendicular with respect to the axis 24. Further, the support member 30 has opposing first and second ends 31A, 31B, the first end 31A being slidably coupled with the lock member 12 and the second end being slidably coupled with the motor 14, as discussed in further detail below.

Although the drive member 18 preferably includes or is provided by a helical spring 26, the drive member 20 may alternatively include a threaded rod or a threaded nut (neither shown). For example, the drive member 18 may be integrally formed with the motor shaft 22 (i.e., a threaded portion of the shaft 22) and include external threads (not shown) formed in the shaft 22 and engageable with the coils 17 of the coupler spring 16. Further for example, the drive member 18 may be a separate threaded rod or other elongated member (not shown) attached to the motor shaft 22 and having external threads providing the helical drive surface(s) 20. As yet another example, the drive member 18 may be formed as nut or a generally cylindrical tube (none shown) having internal threads engageable with the coupler spring 16. The scope of the present invention includes these and all other structures of the drive member 18 that are each threadably engageable with the coupler spring 16 and capable of functioning generally as described herein.

With the above structure, the actuator assembly 10 provides the following functional features and/or advantages over other actuator designs. When the lock member 12 is generally retained at a particular position on the central axis 24, e.g., the member 12 contacts an obstruction, a handle 3 is held "open" as the actuator assembly 10 attempts to "lock", etc., while the motor shaft 22 rotates about the axis 24, substantially the entire coupler spring 16 is either compressed or extended. In other words, when the motor shaft 22 rotates in a first angular direction $A_1$ in an attempt to move the at least temporarily retained lock member 12 in the first direction $L_1$ toward the unlocked position $P_U$, the coupler spring 16 is compressed, and when the motor shaft 22 rotates in a second, opposing angular direction $A_2$ to attempt to move the retained lock member 12 in the second direction $L_2$ toward the locked position $P_L$, essentially the entire coupler spring 16 is extended. As such, the loading is distributed generally evenly along the entire length of coupler spring 16, which is advantageous over an actuator device (none shown) that does not engage an entire section of the coupler spring 16. In other words, with such other actuator devices that engage the coupler spring 16 with a pin (not shown), there is always a section of the coupler spring 16 (i.e., from the area of contact to the outer end) that is not utilized to transfer force or/and store energy. Further, such "pin drives" contact only a small area of one coil 17 of the coupler spring 16 at any particular point in the actuator operation, greatly focusing the pushing or pulling force exerted on the spring 16 as compared to threaded engagement with multiple coils 17, which may greatly increase wear on the spring 16 and/or the associated pin. Furthermore, with the preferred "dual spring" design, i.e., the drive member 18 includes the spring 26, both springs 16, 26 are preferably formed so as to have the same hardness, and therefore wear at the same, predictable rate, which eliminates the necessity of hardening a pin-type drive member (not shown) to that of drawn spring wire.

Another advantage with the actuator 10 that includes a spring drive member 18 is a substantially increased capability of absorbing energy, and conversely a substantially reduced stress on the coupler spring 16, since the drive spring 26 also extends or compresses with the coupler spring 16 when the lock member 12 is retained at a particular position as discussed above. Additionally with the dual spring construction of the actuator assembly 10, the fabrication costs are substantially reduced due to the elimination of small part assembly (e.g., pressing pins into a motor shaft 22) or fabricating a small threaded rod that is free from burrs or other defects. Also, by having two springs 16, 26, the amount of spring overlap or engagement may be increased without the fear of mechanical binding due to misalignment as the springs 16, 26 are flexible. Furthermore, the two spring design is relatively "open" and self-cleaning, such that debris is not likely to become trapped in the engaged sections of springs 16, 26, which could adversely affect actuator operation.

Having described the basic components, operation, and advantages above, these and other elements of the actuator assembly 10 of the present invention are described in further detail below.

Figure 1:
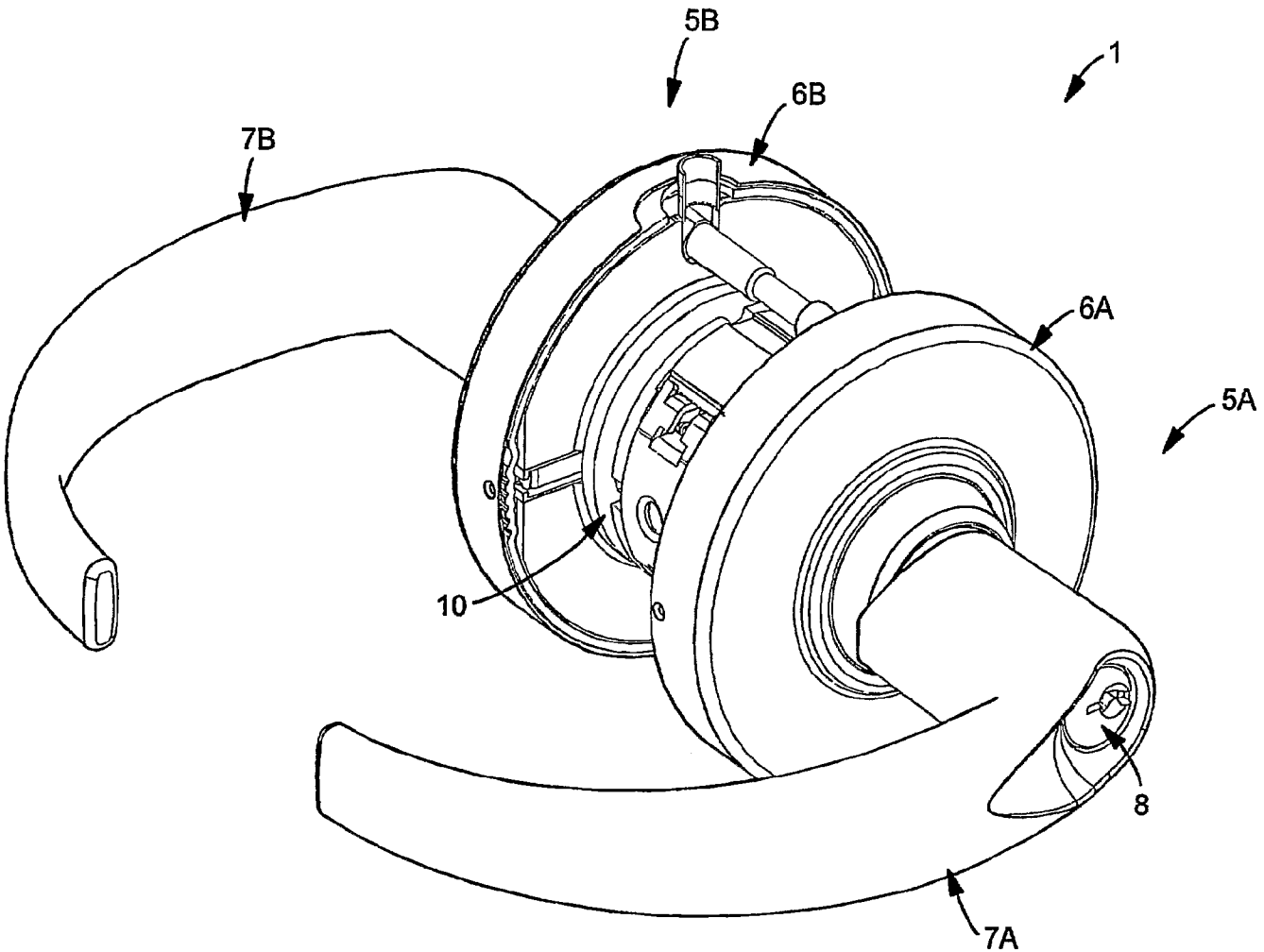
FIG. 1 is a perspective view of an electronic lock assembly including an actuator assembly in accordance with the present invention.

Referring particularly to FIGS. 1 and 2, the actuator assembly 10 of the present invention is depicted as being incorporated in one presently preferred electronic lock 1, although the actuator assembly 10 may be used with any other type of lock 1, as briefly discussed below. The latch 2 is preferably releasably engageable with a strike or similar cavity within a door frame (neither shown) and is preferably biased by a spring 4 into such engagement. The latch 2 is preferably linearly displaceable along an axis 2*a* that extends generally perpendicular to the actuator axis 24 between an engaged or extended position $\mathbf{1}_E$ (as depicted) and a disengaged or retracted position (not shown). Further, the one or two door handles 3 each function to displace the latch 2 out of engagement from the strike when operatively coupled with the latch 2, as described below. Preferably, the lock 1 includes inner and outer handle assemblies 5A, 5B, each including a base member 6A, 6B (e.g., a rose, escutcheon, etc.) mounted to the door and a handle 7A, 7B, supported by the associated base member 5A, 5B so as to be rotatable about a central axis $A_H$, which is preferably collinear with the actuator axis 24, and are each coupled or coupleable with the latch 2. That is, the outer handle 7A is either releasably coupleable by the actuator assembly 10 (FIGS. 2-6) or is permanently coupled with the latch 2 (FIGS. 8 and 9), while the inner handle 7B is generally permanently connected with the latch 2 in both lock constructions.

More specifically, in a first, preferred lock construction shown in FIGS. 2-6, the outer handle 7A is disconnectable from the latch 2 to "lock" the associated door, whereas in a second lock construction depicted in FIGS. 8 and 9, the outer handle 7A always remains coupled with the latch 2 and is prevented or blocked from rotation by the lock member 12, as described below. With either construction, by remaining coupled with the latch 2, the inner handle 7B is preferably always capable of being used to retract the latch 2. Further, the lock 1 preferably further comprises at least one and preferably two retractors or "retractor spindles" 40 each disposed within a separate handle assembly 5A, 5B and operatively coupled with the latch 2. Each retractor spindle 40 is rotatable about the associated handle axis $A_H$ and is configured such that rotation of the spindle 40 pulls/pushes the latch 2 in an inward direction generally along the axis 2*a* against the bias of the spring 4 (i.e., "retracts" the latch 2), and may be configured to both retract and extend the latch 2 (not presently preferred).

Referring to FIGS. 2-6, in the preferred lock construction, the lock member 12 is configured to couple the outer handle 7A with the retractor spindle 40 when the lock member 12 is disposed in the unlocked position $P_U$. The retractor spindle 40 preferably includes a tubular body 42 disposed about the central and handle axes 24, $A_H$ and having a central cavity or bore 43, a recess 44 formed in the body 42, and at least one and preferably two projections or "ears" 46 contactable with the latch 2. As such, rotation of the retractor spindle 40 about the axis 24 causes the ears 46 to push/pull the latch 2, against the biasing action of the spring 5, to a retracted position at which the latch 2 is disengaged from the door strike. Further, the lock 1 also preferably includes a generally tubular coupler spindle 48 disposed about the central and handle axes 24, $A_H$ and coupled with the outer handle 7A by means of a handle spindle 49. The coupler spindle 48 has a central cavity 50, the retractor spindle body 42 being at least partially disposed within the cavity 50, and a slotted opening 52 extending generally parallel with respect to the central axis 24.

Preferably, the lock member 12 includes a plunger 60 disposed at least partially within the spindle cavity 43 and a coupler 62 with a central bore 62*a*. The plunger 60 extends through the coupler bore 62*a* such that the coupler 62 is rotatably slidable about/upon the plunger 60. Further, the coupler 62 has a projection or "dog" 64 extending generally perpendicularly with respect to the axis 24 and having an outer end 64A disposed within the coupler spindle slotted opening 52. The coupler dog 64 is also disposeable within the retractor spindle recess 44 when the lock member 12 is located in the unlocked position $P_U$ (see FIG. 6), so as to thereby operatively couple the outer handle 7A with the latch 2. Specifically, when the handle 5A rotates about the central axis 24, the connected coupler spindle 48 rotates with the handle 5A, causing the retractor spindle 40 to also rotate about the axis 24 when the dog 64 couples the two spindles 42, 48. Such retractor spindle rotation causes one of the retractor projections/ears 46 to push/pull the latch 2 to the retracted position, as described above.

However, when the lock member 12 is located at the locked position $P_L$, the dog 64 is withdrawn from or disposed externally of the retractor recess 44, such that rotation of the handle 5A and coupler spindle 48 only rotates the coupler 64 about the plunger 60, while the plunger 60 and retractor spindle remain angularly fixed with respect to the axis 24. As such, the latch 2 remains located at the extended or engaged position, and the associated door remains locked. Further, the lock 1 also preferably includes a key-operated cylinder lock 8 disposed within the outer handle 7A and having an output spindle cam 9 connectable with the retractor spindle 40, such that rotation of the cylinder lock 8 causes the spindle 40 to retract the latch 2.

Referring to FIGS. 8 and 9, in the second lock construction, the outer handle 7A is generally permanently connected or coupled with the retractor 40 and the lock member 12 is and remains coupled with the retractor 40. The lock member 12 is configured to releasably engage with a fixed base member 80 of the lock 1 to prevent rotation of the handle 7A (and the retractor 40), and thereby prevent retraction of the latch 2. Specifically, the lock member 12 is configured to engage with the base member 80 when located at the locked position $P_L$ so as to substantially prevent rotation of the handle 7A about the axis $A_H$. Alternatively, when located at the unlocked position $P_U$, the lock member 12 is disengaged from the base member 80 such that the handle 7A is capable of rotating about the handle axis $A_H$. Preferably, the fixed base member 80 includes a generally cylindrical block 82 disposed within the outer handle base member 5A so as to be generally immovable or fixed with respect to the actuator and handle axes 24, $A_H$. The base block 82 includes a locking slot 84 extending generally parallel with the actuator axis 24 and sized to receive a portion of the lock member 12, which is preferably constructed generally as described above but having a radially larger dog 64, and an arcuate clearance space 86 sized to permit the lock member 12 to rotate at least partially about the actuator axis 24. It should also be noted that the first construction of the lock 1 also includes the fixed base member 80 (see, e.g., FIG. 5), but such a base member 80 is not configured to be engageable by the lock member 12.

With the above structure, when the lock member 24 is located at the locked position $P_L$, the dog 64 is disposed within the base locking slot 84 such that the lock member 12 is retained or prevented from rotating about the actuator axis 24. Thereby, the coupled retractor spindle 40, and thus the outer handle 7A, are both restrained from rotation about the handle and actuator axes $A_H$, 24, and are thus prevented from retracting the latch 2. Alternatively, when the lock member 12 is located at the unlocked position $P_U$, the preferred dog 64 is disposed within the base clearance space 86. As such, the outer handle 7A is freely rotatable about the collinear handle and actuator axes $A_H$, 24 to rotate the connected retractor spindle 40 and thereby retract the latch 2. When the handle 7A and retractor 40 rotate about the axes $A_H$, 24, the coupled lock member 12 rotates with the retractor 40 such that the dog 64 moves or pivots within the clearance space 86. Other than the primary differences described above, the second lock construction and the structure of the lock member 12 used therewith are generally similar to the first construction lock 1 and the corresponding lock member 12.

Referring now to FIGS. 2-6, 8 and 9, the motor 14, the drive member 18 and at least a section of the coupler spring 16 are preferably disposed within the inner handle assembly 5B, such that the remainder of the coupler spring 16 extends through the associated door and into the outer handle assembly 5A. The inner end 16*a* of the coupler spring 16 is attached to the plunger 60 of the lock member 12, which is slidably disposed within the retractor spindle 40 located in the outer handle assembly 5A. Preferably, a power supply (not shown), such as a battery pack, is disposed within the inner handle assembly 5A and electrically coupled with the motor 14. Further, the support member 30 preferably includes a rod 70 extending between the two handle assemblies 5A, 5B and having opposing first and second ends 70*a*, 70*b*, the rod first end being slidably disposed within a cavity 61 of the plunger 60 and the second end being slidably disposed within a cavity 29 of the drive attachment member 28. As such, the support rod 70 is displaceable by at least a predetermined adjustment distance along the actuator axis 24, which enables the actuator assembly 10 to be adaptable for use with different doors having variations in thickness.

With a lock 1 having two handle assemblies 5A, 5B, as described above, the actuator assembly 10 of the present invention provides another advantage over previous actuator designs. Specifically, the coupler spring 14 and connected outer handle assembly components may be mounted to the door outer surface (not shown) and the drive spring 26 and connected inner handle components may be mounted to the inner handle components, the support rod 70 being initially assembled into one of the two springs 16, 26. Initially, the two spring ends 16*b*, 26*a* are initially compressed against each other, but then rotating the motor shaft 22 in the correct direction will cause the two springs 16, 26 to "self engage" such the spring coils become interwound.

Although the actuator assembly 10 is preferably used with an electronic lock 1 as described above, it is within the scope of the present invention to incorporate the actuator assembly 10 into any other appropriate lock 1. For example, the lock 1 may include one or more push bars (none shown) instead of two handles 3, may have another type of spindle assembly or other structure for operatively coupling the handle(s) 3 with the latch 2, may have a latch member 12 that displaces on axis parallel with, or even angled with respect to, the central axis 24, etc. The scope of the present invention embraces these and all other appropriate constructions of the electronic lock 1, and the actuator assembly 10 is in no manner limited to use with any particular lock structure.

The actuator assembly 10 of the present invention provides numerous advantages over previously known actuators for electronic locks. Besides the advantages already described above, the springs 16, 26 may also be designed to form an overrunning clutch. That is, the two springs 16, 26 will 'pull' together in tension when the motor shaft 22 rotates in one direction until the motor shaft reverses direction. Thereafter, the two springs 16, 26 will 'push' each other in compression up to the point that each free end 16*b*, 26*a* disengages from its counterpart. This point would be predictable and would define a start point or datum for the actuator assembly 10. With such a start point, energy optimizing schemes favorable to battery conservation are employable. That is, such conservation schemes typically use the starting datum as a reference point to start counting motor turns needed to operate the actuator assembly 10 from locked to unlocked configurations, etc. Such a datum point is not available with previous actuator designs.

It will be appreciated by those skilled in the art that changes could be made to the embodiments or constructions described above without departing from the broad inventive concept thereof. It is understood, therefore, that this invention is not limited to the particular embodiments or constructions disclosed, but it is intended to cover modifications within the spirit and scope of the present invention as generally described herein and/or in the attached claims.

I claim:

1. An actuator assembly for an electronic lock, the lock including a lock member linearly displaceable between a locked position and an unlocked position, the actuator comprising:

a motor having a shaft rotatable about a central axis;

a coupler spring disposed about the axis and having a first end coupled with the lock member and a second, opposing end; and a drive member one of coupled with and integrally formed with the motor shaft and having a helical drive surface threadably engaged with the coupler spring second end such that rotation of the motor shaft displaces the coupler spring generally linearly along the axis to move the lock member between the locked and unlocked positions, wherein the drive member includes a helical spring having a first end threadably engaged with the coupler spring and a second end connected with the motor shaft.

2. The actuator assembly as recited in claim 1 wherein the drive member helical surface extends circumferentially about and linearly along the central axis.

3. The actuator assembly as recited in claim 1 wherein:

the coupler spring second end has a plurality of coils, each coil having opposing, first and second axially-facing surfaces;

the helical drive surface is a first helical drive surface contactable with the coil first surfaces when the motor shaft rotates in a first angular direction about the central axis so as to displace the coupler spring in a second linear direction along the axis; and the drive member further includes a second, opposing helical drive surface, the second helical drive surface being contactable with the coil second surfaces when the motor rotates in a second angular direction about the central axis so as to displace the coupler spring in a second linear direction along the axis.

4. The actuator assembly as recited in claim 1 wherein the helical surface engages a portion of the coupler spring, the coupler spring engaged shaft portion including a plurality of coils.

5. The actuator assembly as recited in claim 1 further comprising an elongated support member extending generally along the axis and having a first portion disposed within the coupler spring and a second portion disposed within the drive member spring such that the support member retains each of the coupler spring and the coil spring generally centered about the axis.

6. The actuator assembly as recited in claim 5 wherein the support member is a rod having opposing first and second ends, the rod first end being slidably coupled with the lock member and the rod second end being slidably coupled with the motor such that the support rod is displaceable by at least a predetermined adjustment distance along the axis.

7. The actuator assembly as recited in claim 1 wherein the drive member is integrally formed with the motor shaft and includes external threads formed in the motor shaft and engageable with the coupler spring.

8. An actuator assembly for an electronic lock, the lock including a lock member linearly displaceable between a locked position and an unlocked position, the actuator comprising:

a motor having a shaft rotatable about a central axis;

a coupler spring disposed about the axis and having a first end coupled with the lock member and a second, opposing end; and a drive member one of coupled with and integrally formed with the motor shaft and having a helical drive surface threadably engaged with the coupler spring second end such that rotation of the motor shaft displaces the coupler spring generally linearly along the axis to move the lock member between the locked and unlocked positions, wherein the drive member includes a generally cylindrical tube having internal threads engageable with the coupler spring.

9. The actuator assembly as recited in claim 1 wherein when the locking member is generally retained at a particular position on the central axis while the motor shaft rotates about the axis, substantially the entire coupler spring is one of compressed and extended.

10. The actuator assembly as recited in claim 9 wherein when the motor shaft rotates in a first angular direction, the coupler spring is compressed and when the motor shaft rotates in a second, opposing angular direction, the coupler spring is extended.

11. The actuator assembly as recited in claim 1 wherein the lock further includes handle rotatable about an axis and a retractor spindle operatively coupled with the latch, the lock member being configured to couple the handle with the retractor spindle when the lock member is disposed in the unlocked position such that rotation of the handle about the axis retracts the latch, the handle being noncoupled with the retractor when the lock member is disposed at the locked position.

12. The actuator assembly as recited in claim 1 wherein:

the lock further includes a handle rotatable about an axis, a fixed base member, the handle being rotatably coupled with the base member, and a retractor spindle operatively coupled with the latch and connected with the handle such that rotation of the handle rotates the retractor to retract the latch; and the lock member is coupled with the retractor and engageable with the base member when disposed at locked position so as to substantially prevent rotation of the handle, the lock member being disengaged from the base member when disposed at the unlocked position such that the handle is rotatable about the handle axis.

13. An actuator assembly for an electronic lock, the lock including a lock member linearly displaceable between a locked position and an unlocked position, the actuator comprising:

a motor having a shaft rotatable about a central axis;

a coupler spring having a first end coupled with the lock member and a second, opposing end; and a drive spring coupled with the motor shaft and threadably engaged with the coupler spring second end such that rotation of the motor shaft displaces the coupler spring generally linearly along the axis to move the lock member between the locked and unlocked positions.

14. The actuator assembly as recited in claim 13 wherein each one of the coupler spring and the drive spring includes a helical spring.

15. The actuator assembly as recited in claim 13 wherein:

the coupler spring second end has a plurality of coils, each coil having opposing, first and second axially-facing surfaces; and the drive spring has a first and second opposing helical drive surfaces, the first drive surface being contactable with the coil first surfaces when the motor shaft rotates in a first angular direction about the central axis so as to displace the coupler spring in a first linear direction along the axis, the second drive surface being contactable with the coil second surfaces when the motor rotates in a second angular direction about the central axis so as to displace the coupler spring in a second linear direction along the axis.

16. The actuator assembly as recited in claim 13 further comprising an elongated support member extending generally along the axis and having a first portion disposed within the coupler spring and a second portion disposed within the drive spring such that the support member retains each of the coupler spring and the drive spring generally centered about the axis.

17. The actuator assembly as recited in claim 13 wherein when the locking member is generally retained at a particular position on the central axis while the motor shaft rotates about the axis, substantially the entire coupler spring is one of compressed and extended.

18. An electronic lock comprising:

a linearly displaceable latch;

a rotatable handle operatively coupleable with the latch;

a lock member linearly displaceable between a locked position at which the handle is noncoupled with latch and an unlocked position at which the lock member operatively couples the handle with the latch;

a motor having a shaft rotatable about a central axis;

a coupler spring having a first end coupled with the locking member and a second, opposing end; and a drive spring coupled with the motor shaft and threadably engaged with the coupler spring second end such that rotation of the motor shaft displaces the coupler spring generally linearly along the axis to move the lock member between the locked and unlocked positions.

19. The lock as recited in claim 18 further comprising a retractor spindle operatively coupled with the latch, the lock member being configured to couple the handle with the retractor spindle when the lock member is disposed in the unlocked position.

20. The actuator assembly as recited in claim 19 wherein:

the lock further includes a generally tubular coupler spindle coupled with the handle and having a central cavity and a slotted opening extending generally parallel with respect to the central axis;

the retractor spindle includes a tubular body disposed at least partially within the coupler spindle cavity and having a central cavity, a recess formed in the body, and at least one projection contactable with the latch; and the locking unit includes a plunger disposed at least partially within the spindle cavity and a coupler with a central bore, the plunger extending through the coupler bore such that the coupler is rotatably slidable upon the plunger, the coupler having a projection extending generally perpendicularly with respect to the axis, having an outer end disposed within the coupler spindle outer opening, and being disposeable within the retractor spindle recess when the locking unit is located in the unlocked position so as to operatively couple the handle with the latch such that when the handle rotates about the axis, the retractor spindle projection displaces the latch.

21. An electronic lock comprising:

a fixed base member;

a latch linearly displaceable between an extended position and a retracted position;

a retractor spindle configured to displace the latch toward the retracted position;

a handle rotatable about an axis, operatively coupled with the latch and configured to displace the latch toward the retracted position when the handle rotatably displaces about the axis;

a lock member coupled with the retractor spindle and linearly displaceable between a locked position, at which the lock member is engaged with the base member so as to substantially prevent rotation of the handle about the handle axis, and an unlocked position at which the locking member is noncoupled with the base member such that the handle is rotatable about the handle axis;

a motor having a shaft rotatable about a central axis;

a coupler spring having a first end coupled with the locking member and a second, opposing end; and a drive spring coupled with the motor shaft and threadably engaged with the coupler spring second end such that rotation of the motor shaft displaces the coupler spring generally linearly along the axis to move the lock member between the locked and unlocked positions.

22. An actuator assembly for an electronic lock, the lock including a locking member linearly displaceable between locked and unlocked positions, the actuator comprising:

a motor having a shaft rotatable about a central axis;

a coupler spring having a first end coupled with the locking member and a second, opposing end; and a drive member one of coupled with and integrally formed with the motor shaft and engaged with the coupler spring second end, the drive member having at least one helical drive surface contactable with at least one coil of the coupler spring such that rotation of the motor shaft displaces the coupler spring generally linearly along the axis to move the locking member between the locked and unlocked positions, wherein the drive member includes a helical spring having a first end threadably engaged with the coupler spring and a second end connected with the motor shaft.

* * * * *